US009861257B2

(12) United States Patent
Durham et al.

(10) Patent No.: US 9,861,257 B2
(45) Date of Patent: Jan. 9, 2018

(54) DETERGENT DISPENSER MODULE FOR A DISHWASHING APPLIANCE

(71) Applicant: General Electric Company, Schenectady, NY (US)

(72) Inventors: Kyle Edward Durham, Louisville, KY (US); Christopher Brandon Ross, Louisville, KY (US); Gregory Owen Miller, Louisville, KY (US); Craig Curtis, Crestwood, KY (US)

(73) Assignee: HAIER US APPLIANCE SOLUTIONS, INC., Wilmington, DE (US)

( * ) Notice: Subject to any disclaimer, the term of this patent is extended or adjusted under 35 U.S.C. 154(b) by 430 days.

(21) Appl. No.: 14/608,522

(22) Filed: Jan. 29, 2015

(65) Prior Publication Data

US 2016/0220094 A1 Aug. 4, 2016

(51) Int. Cl.
*A47L 15/44* (2006.01)

(52) U.S. Cl.
CPC ..... *A47L 15/4436* (2013.01); *A47L 15/4409* (2013.01)

(58) Field of Classification Search
CPC .. A47L 15/4409; A47L 15/4418; A47L 15/44; A47L 15/4436; A47L 15/4463
USPC ..... 134/93, 56 D, 57 D, 58 D, 99.2, 25.2, 134/115 R, 94.1, 186, 100.1, 95.1; 222/651, 129, 160, 173, 504, 511, 108, 222/491
See application file for complete search history.

(56) References Cited

U.S. PATENT DOCUMENTS

| | | | | |
|---|---|---|---|---|
| 3,262,604 | A * | 7/1966 | Barnard | A47L 15/4409 222/504 |
| 5,884,821 | A * | 3/1999 | Wilhelmstaetter | A47L 15/4409 134/93 |
| 6,622,896 | B2 * | 9/2003 | Hegeman | A47L 15/4409 134/57 D |
| 7,302,956 | B2 * | 12/2007 | Cerruti | A47L 15/4418 134/114 |
| 8,608,866 | B2 * | 12/2013 | Francisco | A47L 15/0028 134/104.1 |
| 8,808,466 | B2 * | 8/2014 | Bertsch | A47L 15/4409 134/56 D |
| 2003/0188768 | A1 * | 10/2003 | Cerruti | A47L 15/4409 134/57 D |

(Continued)

*Primary Examiner* — David Cormier
*Assistant Examiner* — Thomas Bucci
(74) *Attorney, Agent, or Firm* — Dority & Manning, P.A.

(57) ABSTRACT

A detergent dispenser module for a dishwashing appliance may generally include a body extending between a top side and a bottom side. The body may include an outer surface extending from the top side and may define a detergent chamber between the outer surface and the bottom side. The detergent chamber may be at least partially formed by an upper sidewall, a lower sidewall and a bottom wall extending between the upper and lower sidewall. In addition, the dispenser module may also include at least one flow diverter extending outwardly from the outer surface at a location adjacent to the upper sidewall of the detergent chamber. The flow diverter(s) may be angled in a direction of a fluid collection opening defined through a top of the upper sidewall such that fluid flowing downwardly along the outer surface of the body is directed into the fluid collection opening.

19 Claims, 9 Drawing Sheets

(56) References Cited

U.S. PATENT DOCUMENTS

| | | | | |
|---|---|---|---|---|
| 2005/0103365 | A1* | 5/2005 | Cerruti | A47L 15/4409 134/93 |
| 2005/0115595 | A1* | 6/2005 | Cerruti | A47L 15/4409 134/93 |
| 2008/0223417 | A1* | 9/2008 | Cerruti | A47L 15/4409 134/93 |

* cited by examiner

DETERGENT DISPENSER MODULE FOR A DISHWASHING APPLIANCE

FIELD OF THE INVENTION

The present subject matter relates generally to dishwashing appliances and, more particularly, to a detergent dispenser module for dispensing a suitable detergent(s) into a wash chamber of a dishwashing appliance.

BACKGROUND OF THE INVENTION

Modern dishwashers typically include a tub defining a wash chamber where e.g., detergent, water, and heat can be applied to clean food or other materials from dishes and other articles being washed. Various cycles may be included as part of the overall cleaning process. For example, a typical, user-selected cleaning option may include a wash cycle and rinse cycle (referred to collectively as a wet cycle), as well as a drying cycle. A pre-wash cycle may also be included as part of the wet cycle, and may be automatic or an option for particularly soiled dishes.

To provide detergent for release within the wash chamber, dishwashers typically include a detergent dispenser mounted onto the interior of the door of the dishwasher. The dispenser generally corresponds to a refillable compartment that is configured to be accessed by means of a removably attachable cover. During use, detergent is placed within the dispenser compartment before a wet cycle is executed. Thereafter, during the wet cycle, a spray jet is typically configured to direct water at the compartment when a timer releases its cover so as to washout or remove the detergent from the dispenser.

To provide for maximum detergent capacity, the size of each compartment defined within conventional dispensers continues to be increased. Typically, this increase in size corresponds to an increase in the depth of the compartment. Unfortunately, such an increase in the depth of the compartment provides for a corresponding increase in the difficulty for directing spray jets into the bottom of the compartment for washing out the detergent. As a result, a portion of the detergent may still remain within the compartment at the end of wet cycle.

Accordingly, an improved detergent dispenser module that enhances the flow of fluid through the dispenser to assist in washing out the detergent contained therein would be welcomed in the technology.

BRIEF DESCRIPTION OF THE INVENTION

Aspects and advantages of the invention will be set forth in part in the following description, or may be obvious from the description, or may be learned through practice of the invention.

In one aspect, the present subject matter is directed to a detergent dispenser module for a dishwashing appliance. The dispenser module may generally include a body extending between a top side and a bottom side. The body may include an outer surface extending from the top side and may define a detergent chamber between the outer surface and the bottom side. The detergent chamber may be at least partially formed by an upper sidewall, a lower sidewall and a bottom wall extending between the upper and lower sidewall. In addition, the dispenser module may also include at least one flow diverter extending outwardly from the outer surface at a location adjacent to the upper sidewall of the detergent chamber. The flow diverter(s) may be angled in a direction of a fluid collection opening defined through a top of the upper sidewall such that fluid flowing downwardly along the outer surface of the body is directed into the fluid collection opening.

In another aspect, the present subject matter is directed to a detergent dispenser module for a dishwashing appliance. The dispenser module may include a body extending between a top side and a bottom side. The body may include an outer surface extending from the top side and may define a detergent chamber between the outer surface and the bottom side. The detergent chamber may be at least partially formed by an upper sidewall, a lower sidewall and a bottom wall extending between the upper and lower sidewalls. The upper sidewall may define a fluid collection opening at a top of the upper sidewall that is in fluid communication with the outer surface. In addition, the dispenser module may also include first and second sidewall ribs extending lengthwise along the upper sidewall of the detergent chamber. The first sidewall rib may be spaced apart from the second sidewall rib such that a flow channel is defined between the first and second sidewall ribs. The flow channel may be in flow communication with the fluid collection opening such that fluid flowing downwardly along the outer surface of the body is directed through the fluid collection opening and into the flow channel for transport within the flow channel along the upper sidewall towards the bottom wall of the detergent chamber.

In a further aspect, the present subject matter is directed to a detergent dispenser module for a dishwashing appliance. The dispenser module may include a body extending between a top side and a bottom side. The body may include an outer surface extending from the top side and may define a detergent chamber between the outer surface and the bottom side. The detergent chamber may be at least partially formed by an upper sidewall, a lower sidewall and a bottom wall extending between the upper and lower sidewalls. The upper sidewall may define a fluid collection opening at a top of the upper sidewall that is in fluid communication with the outer surface. In addition, the dispenser module may also include a spreader rib projecting outwardly from the bottom wall of the detergent chamber. The spreader rib may extend at least partially along an outer perimeter of the bottom wall defined at an interface between the bottom wall and the upper sidewall of the detergent chamber such that, when fluid flowing downwardly along the outer surface of the body travels through the fluid collection opening and is directed along the upper sidewall towards the bottom wall, the spreader rib is configured to spread out the flow of fluid along a width of the bottom wall.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
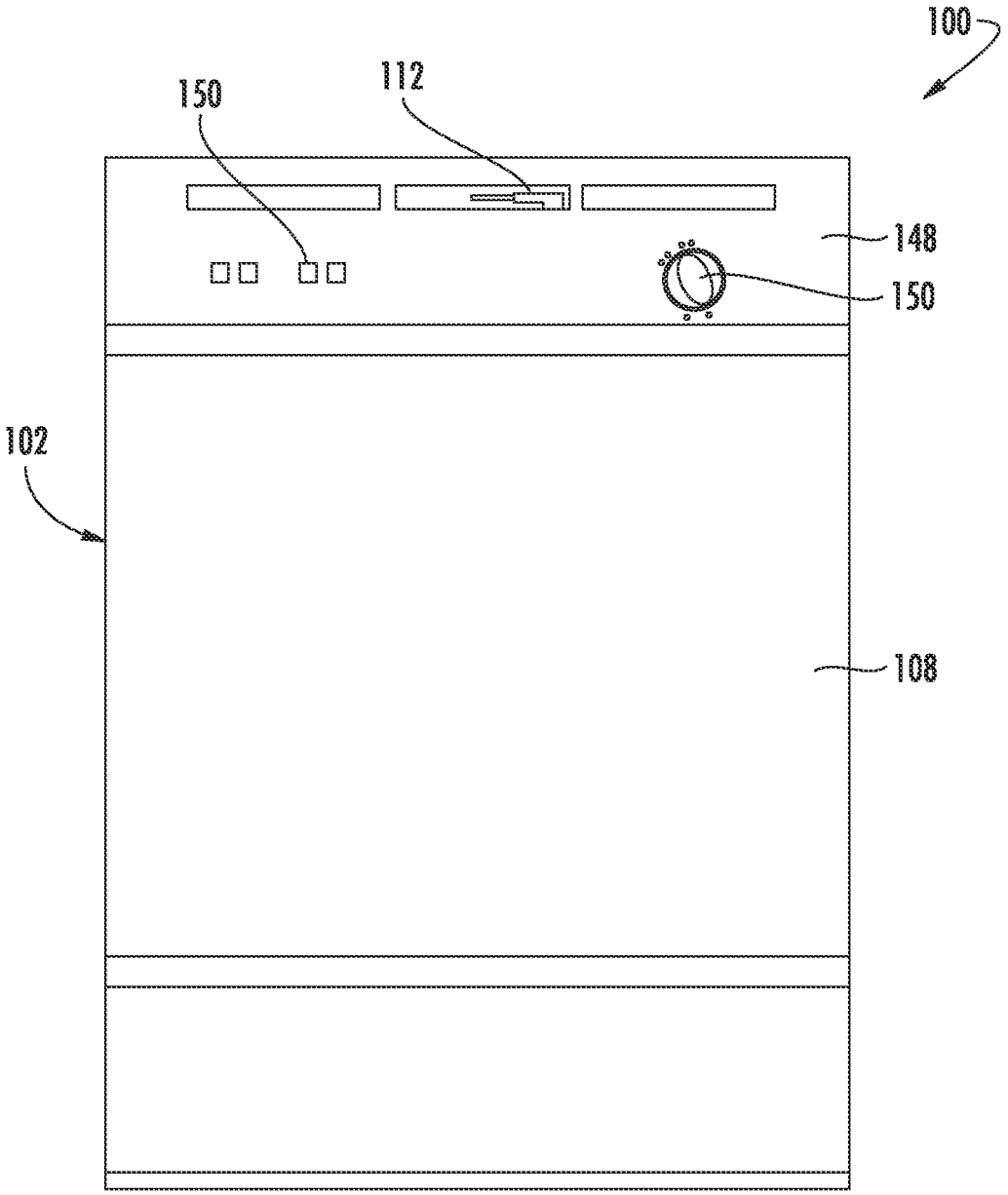
FIG. 1 illustrates a front view of one embodiment of a dishwashing appliance in accordance with aspects of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In general, the present subject matter is directed to a detergent dispenser module for a dishwashing appliance. Specifically, in several embodiments, the dispenser module may include a plurality of flow control features configured to control the flow of water being directed downward across an outer surface of the dispenser module from the inner wall of the dishwasher door (i.e., the front sidewall of the dishwasher tub) such that a substantial portion of the water is diverted into a detergent chamber defined by the dispenser module, thereby allowing for improved washout of the detergent contained therein. For example, as will be described in detail below, the dispenser module may include at least one angled flow diverter extending outwardly from the outer surface of the dispenser module that is configured to catch the water flowing downwardly along the outer surface and divert such water to a fluid collection opening defined in an upper sidewall of the detergent chamber. For instance, in one embodiment, the diverter module may include a first angled flow diverter and a second angled flow diverter spaced apart from one another such that the fluid collection opening is defined directly between the flow diverters. In such an embodiment, each flow diverter may be angled downwardly in the direction of the fluid collection opening such that the water flowing along the outer surface is diverted to the fluid collection opening.

In addition, the dispenser module may also include one or more pairs of adjacent sidewall ribs extending lengthwise along the upper sidewall of the detergent chamber from the top of the chamber to a bottom wall of the chamber. Each pair of adjacent sidewall ribs may be spaced apart from one another such that a fluid channel is defined between the ribs, with each fluid channel being configured to divert water flowing through the fluid collection opening into the detergent chamber along the upper sidewall. Specifically, in several embodiments, the water flowing through the fluid collection opening may be directed into the fluid channel(s) and may subsequently flow downwardly into the cavity along the length of the sidewall ribs due to the surface tension present between the water and the ribs.

Moreover, the dispenser module may also include one or more flow control features located at or adjacent to the bottom wall of the detergent chamber. For example, in several embodiments, the dispenser module may include a spreader rib extending outwardly from the bottom wall at one or more locations along the outer perimeter of the bottom wall. The spreader rib may generally be configured to spread the flow of water directed downward into the chamber via the flow channels defined by the sidewall ribs along the entire width of the bottom wall. Such spreading of the flow of water along the bottom wall may generally assist in washing out any detergent that remains stuck to the bottom wall. In addition, the dispenser module may also include a fluid collection wall extending outwardly from the bottom wall of the chamber at or adjacent to the interface defined between the bottom wall and a lower sidewall of the chamber. The fluid collection wall may generally be configured to at least partially block the flow of water spread out along the bottom wall of the detergent chamber from being directed straight upward along the lower sidewall of the chamber. As such, a portion of the water flowing along the bottom wall may be retained at or adjacent to the bottom wall for a longer period of time, thereby further enhancing detergent washout from the chamber.

It should be appreciated that, as used herein, the term "detergent" is used broadly and is intended to include detergents, rinse aid additives, sanitizing additives, and any other types of additives that might be used during a wet cycle and/or any other suitable cycle of an automatic dishwashing appliance. In addition, it should be appreciated that detergents may be in powder, liquid, gel or capsule form.

Figure 2:
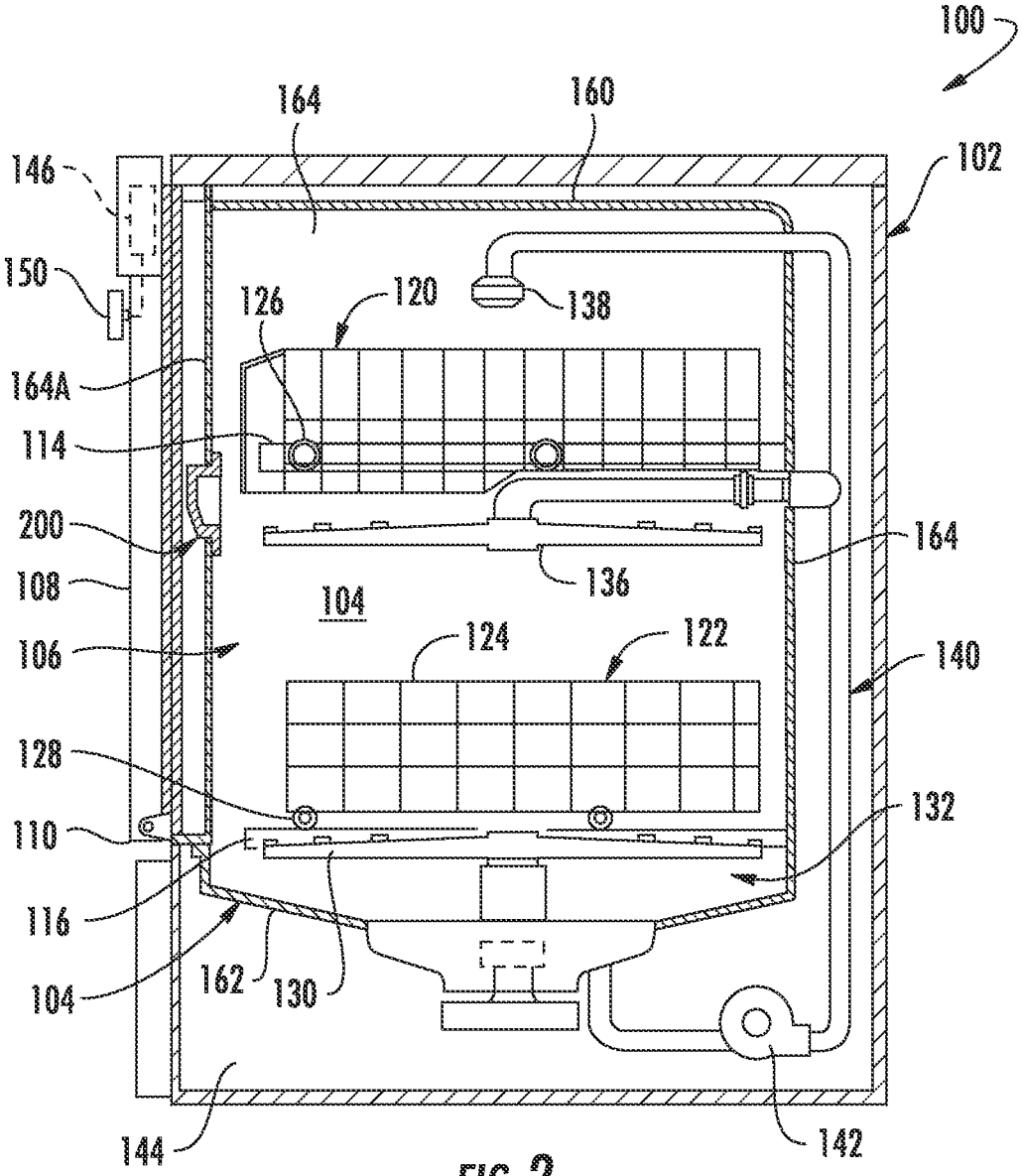
FIG. 2 illustrates a cross-sectional side view of the dishwashing appliance shown in FIG. 1, particularly illustrating various internal components of the dishwashing appliance.
Figure 3:
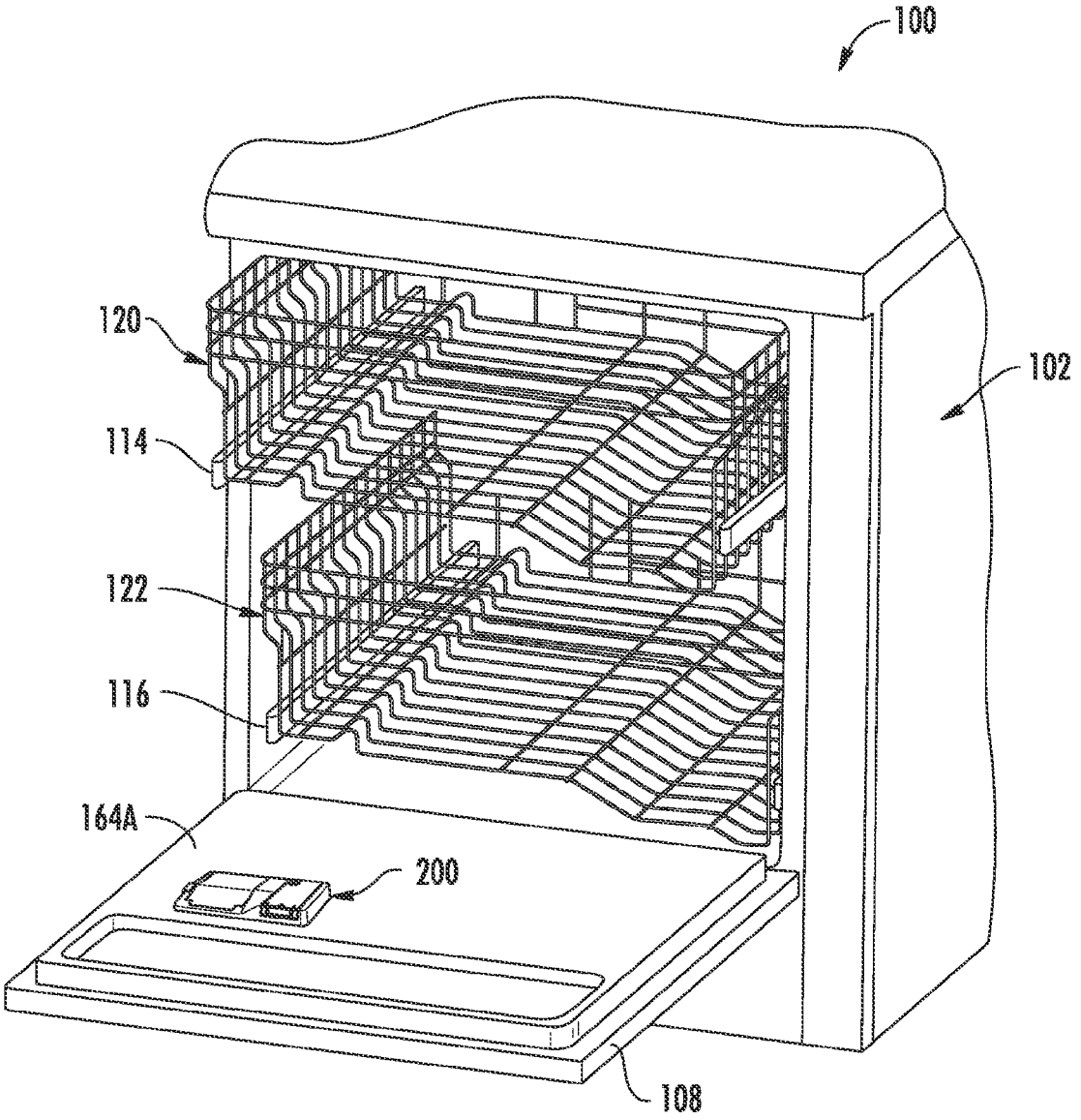
FIG. 3 illustrates a perspective view of the dishwashing appliance shown in FIG. 1 with a door of the appliance moved to an opened position, particularly illustrating a detergent dispenser module mounted to an inner wall of the door in accordance with aspects of the present subject matter.

Referring now to the drawings, FIGS. 1-3 illustrate one embodiment of a domestic dishwashing appliance 100 that may be configured in accordance with aspects of the present disclosure. As shown in the illustrated embodiment, the dishwashing appliance 100 may include a cabinet 102 having a tub 104 therein defining a wash chamber 106. The tub 104 may generally include a front opening (not shown) and a door 108 hinged at its bottom 110 for movement between a normally closed vertical position (shown in FIGS. 1 and 2), wherein the wash chamber 106 is sealed shut for washing operation, and a horizontal open position (shown in FIG. 3) for loading and unloading of articles from the dishwasher. As shown in FIG. 1, a latch 112 may be used to lock and unlock the door 108 for access to the chamber 106.

As is understood, the tub 104 may generally have a rectangular cross-section defined by various wall panels or walls. For example, as shown in FIG. 2, the tub 104 may include a top wall 160 and a bottom wall 162 spaced apart from one another along a vertical direction V of the dishwashing appliance 100. Additionally, the tub 104 may include a plurality of sidewalls 164 (e.g., four sidewalls) extending between the top and bottom walls 160, 162. As shown in FIG. 3, a front sidewall 164A of the tub 104 may generally define the inner wall or inner surface of the door 108. It should be appreciated that the tub 104 may generally be formed from any suitable material. However, in several embodiments, the tub 104 may be formed from a ferritic material, such as stainless steel, or a polymeric material.

As particularly shown in FIG. 2, upper and lower guide rails 114, 116 may be mounted on opposing side walls 164 of the tub 104 and may be configured to accommodate roller-equipped rack assemblies 120 and 122. Each of the rack assemblies 120, 122 may be fabricated into lattice structures including a plurality of elongated members 124 (for clarity of illustration, not all elongated members making up assemblies 120 and 122 are shown in FIG. 2). Additionally, each rack 120, 122 may be adapted for movement between an extended loading position (not shown) in which the rack is substantially positioned outside the wash chamber 106, and a retracted position (shown in FIGS. 1 and 2) in which the rack is located inside the wash chamber 106. This may be facilitated by rollers 126 and 128, for example, mounted onto racks 120 and 122, respectively. As is generally understood, a silverware basket (not shown) may be removably attached to rack assembly 122 for placement of silverware, utensils, and the like, that are otherwise too small to be accommodated by the racks 120, 122.

Additionally, the dishwashing appliance 100 may also include a lower spray-arm assembly 130 that is configured to be rotatably mounted within a lower region 132 of the wash chamber 106 directly above the bottom wall 162 of the tub 104 so as to rotate in relatively close proximity to the rack assembly 122. As shown in FIG. 2, a mid-level spray-arm assembly 136 may be located in an upper region of the wash chamber 106, such as by being located in close proximity to the upper rack 120. Moreover, an upper spray assembly 138 may be located above the upper rack 120.

As is generally understood, the lower and mid-level spray-arm assemblies 130, 136 and the upper spray assembly 138 may generally form part of a fluid circulation system 140 for circulating fluid (e.g., water and dishwasher fluid) within the tub 104. As shown in FIG. 2, the fluid circulation system 140 may also include a pump 142 located in a machinery compartment 144 below the bottom wall 162 of the tub 104, as is generally recognized in the art. Moreover, each spray-arm assembly 130, 136 may include an arrangement of discharge ports or orifices for directing washing liquid onto dishes or other articles located in rack assemblies 120 and 122, which may provide a rotational force by virtue of washing fluid flowing through the discharge ports. The resultant rotation of the lower spray-arm assembly 130 provides coverage of dishes and other dishwasher contents with a washing spray.

The dishwashing appliance 100 may be further equipped with a controller 146 configured to regulate operation of the dishwasher 100. The controller 146 may generally include one or more memory devices and one or more microprocessors, such as one or more general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

The controller 146 may be positioned in a variety of locations throughout dishwashing appliance 100. In the illustrated embodiment, the controller 146 is located within a control panel area 148 of the door 108, as shown in FIG. 1. In such an embodiment, input/output ("I/O") signals may be routed between the control system and various operational components of the dishwashing appliance 100 along wiring harnesses that may be routed through the bottom 110 of the door 108. Typically, the controller 146 includes a user interface panel/controls 150 through which a user may select various operational features and modes and monitor progress of the dishwasher 100. In one embodiment, the user interface 150 may represent a general purpose I/O ("GPIO") device or functional block. Additionally, the user interface 150 may include input components, such as one or more of a variety of electrical, mechanical or electro-mechanical input devices including rotary dials, push buttons, and touch pads. The user interface 150 may also include a display component, such as a digital or analog display device designed to provide operational feedback to a user. As is generally understood, the user interface 150 may be in communication with the controller 146 via one or more signal lines or shared communication busses.

Moreover, the dishwashing appliance 100 may also include a detergent dispenser module 200 for dispensing a suitable detergent(s) within the wash chamber 106. As shown in FIGS. 2 and 3, in several embodiments, the dispenser module 200 may be configured to be mounted along the front sidewall 164A of the tub 104 (i.e., the inner wall of the door 108). As such, when the door 108 is moved to its open position, the dispenser module 200 may be easily accessed for adding new detergent(s) within the module 200. Additionally, during operation of the dishwashing appliance 100, a portion of the water discharged from the spray-arm assemblies, particularly the mid-level and upper spray-arm assemblies 136, 138, may be directed against the front sidewall 164A of the tub 104 and may flow downwardly along such wall 164A across the portion of the dispenser module 200 facing the interior of the wash chamber 106. As will be described below, the dispenser module 200 may include one or more flow control features for controlling the flow of water directed across the module 200 as it falls downwardly along the front sidewall 164A of the tub 104. Such flow control features may generally assist in removing or otherwise washing out any detergent contained within the dispenser module 200.

It should be appreciated that the present subject matter is not limited to any particular style, model, or configuration of dishwashing appliance. The exemplary embodiment depicted in FIGS. 1 and 2 is simply provided for illustrative purposes only. For example, different locations may be provided for the user interface 150, different configurations may be provided for the racks 120, 122, and other differences may be applied as well.

Figure 4:
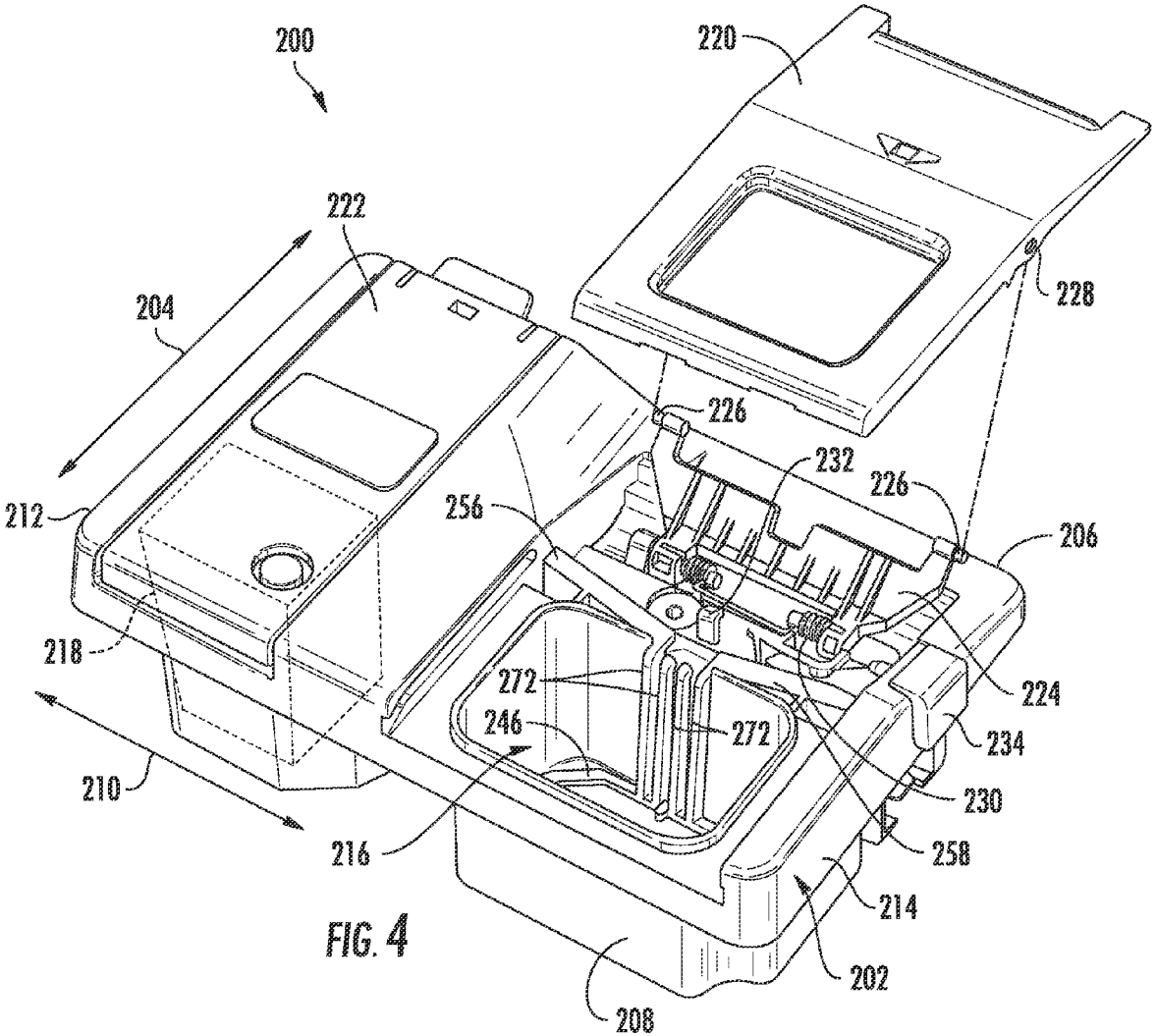
FIG. 4 illustrates a front perspective view of one embodiment of a detergent dispenser module that may be suitable for use within the dishwashing appliance shown in FIGS. 1-3 in accordance with aspects of the present subject matter, particularly illustrating a cover of the dispenser module being exploded away to show one of the detergent chambers of the module.
Figure 5:
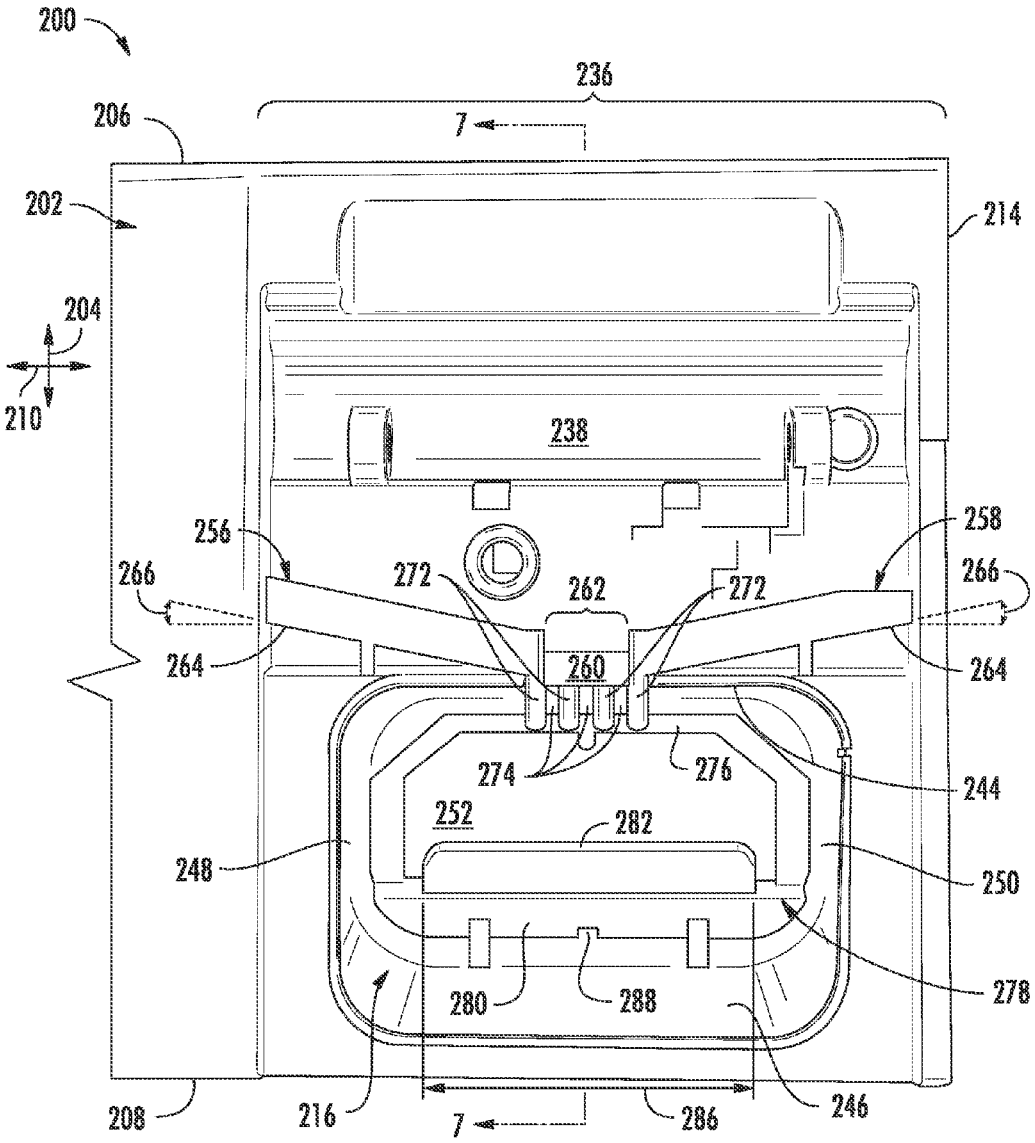
FIG. 5 illustrates a top, partial view of the dispenser module shown in FIG. 4, particularly illustrating a compartment section of the dispenser module shown in FIG. 4 with the cover and various cover-related components of the module being removed for purposes of illustration.
Figure 6:
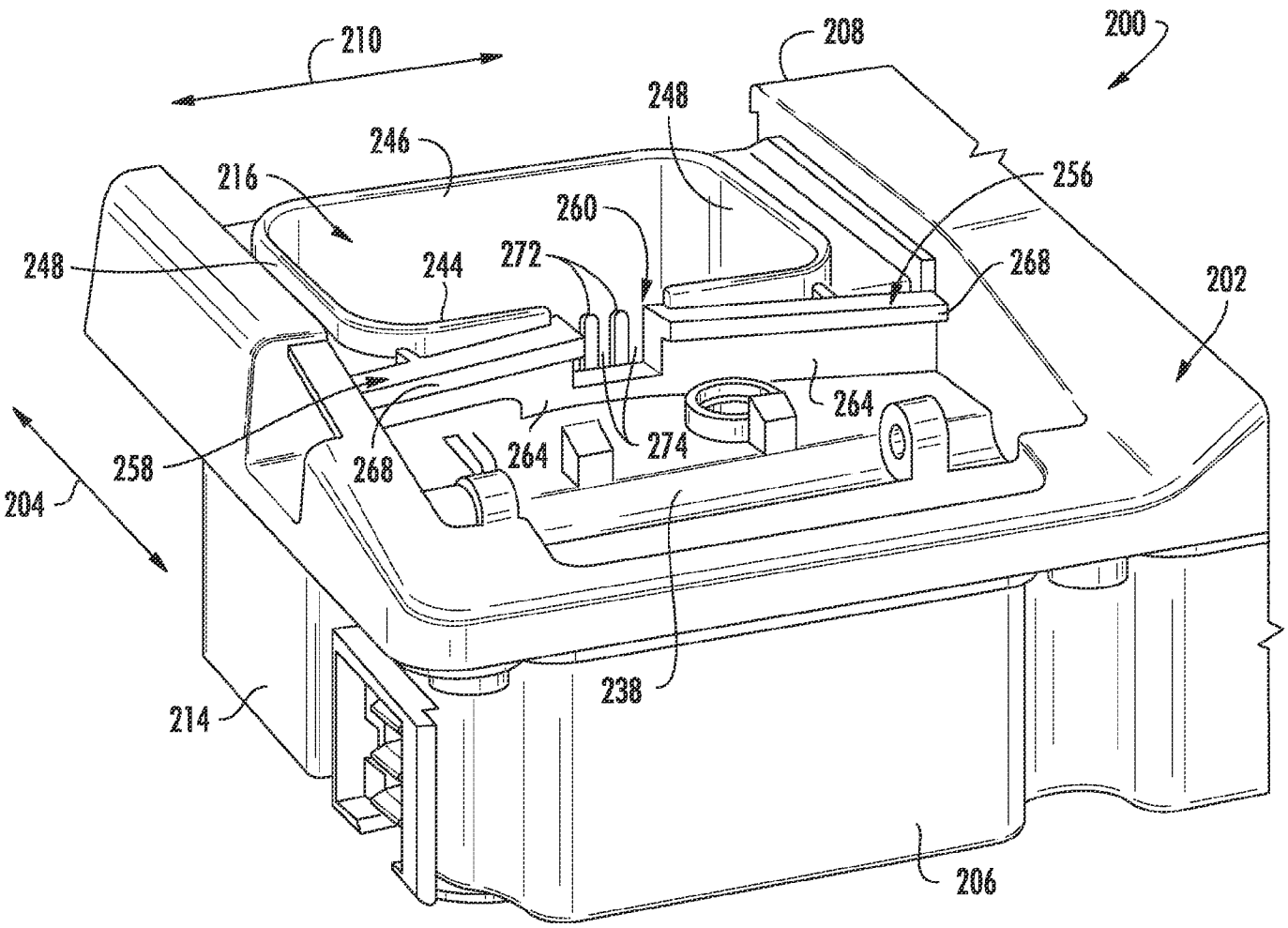
FIG. 6 illustrates a rear perspective view of the dispenser module shown in FIG. 5.
Figure 7:
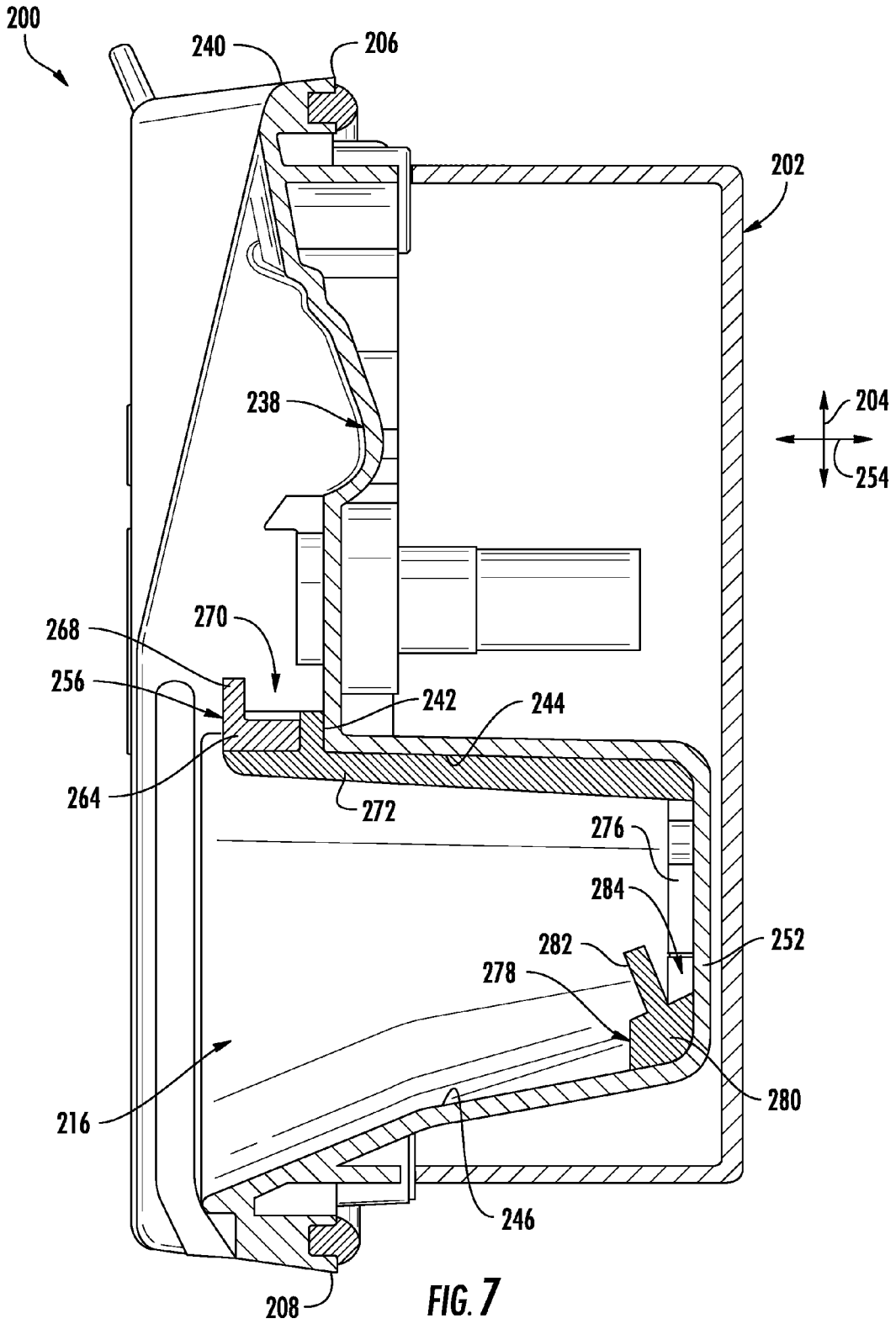
FIG. 7 illustrates a cross-sectional view of the dispenser module shown in FIG. 5 taken about line 7-7.
Figure 8:
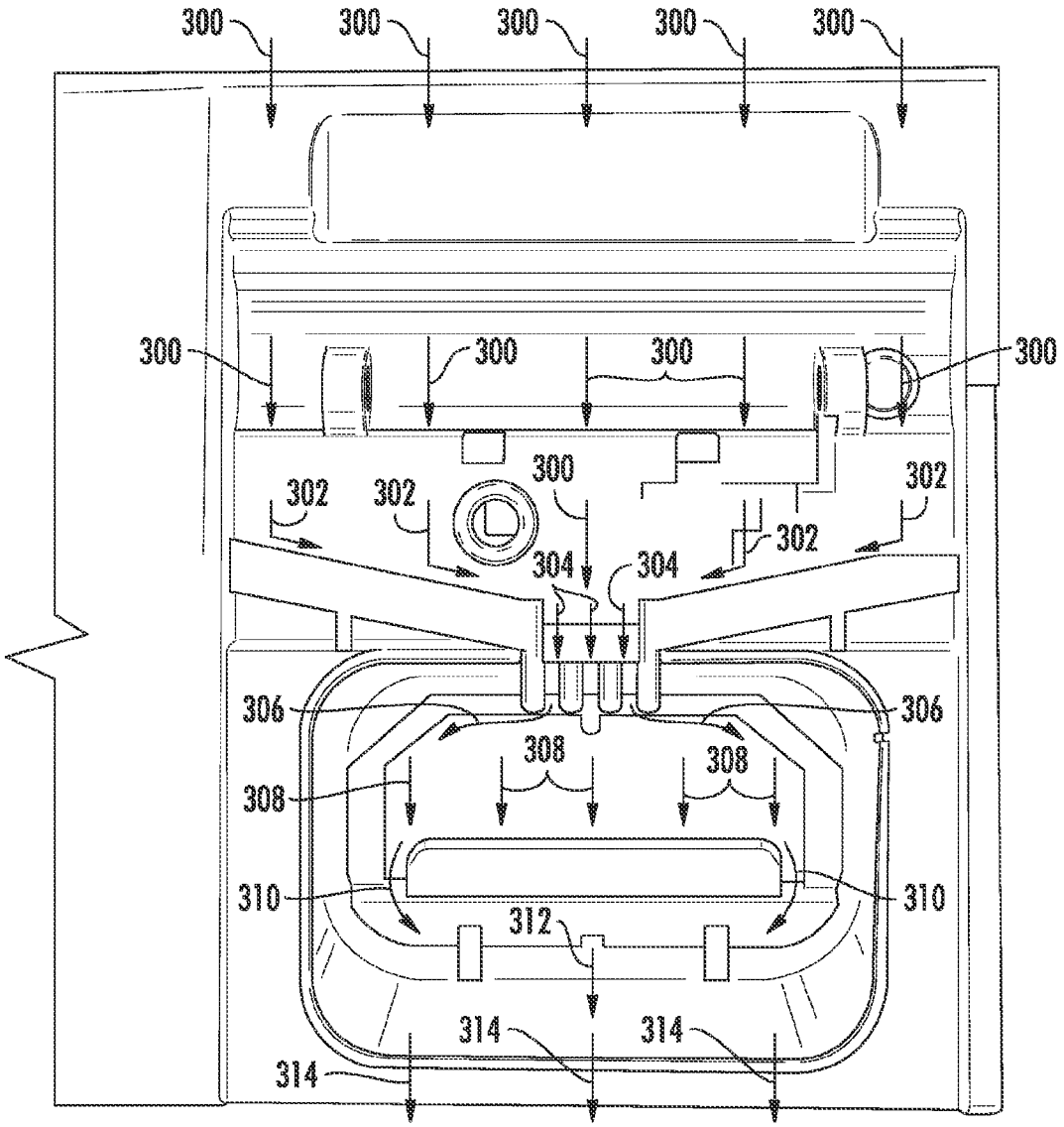
FIG. 8 illustrates the same top, partial view of the dispenser module shown in FIG. 5, particularly illustrating one example of a suitable flow path for water being directed through the dispenser module.
Figure 9:
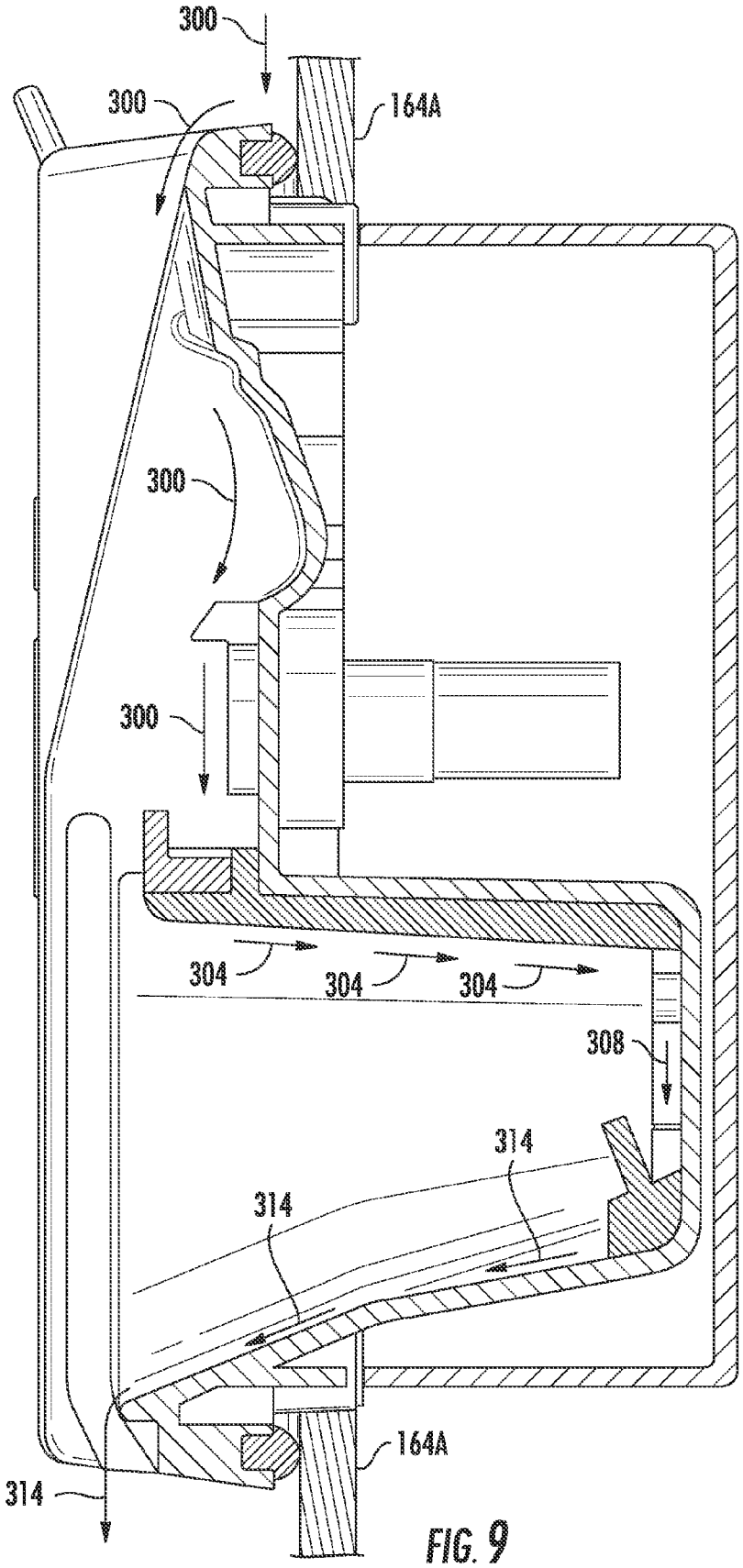
FIG. 9 illustrates the same cross-sectional view of the dispenser module shown in FIG. 7, particularly illustrating a differing view of the water flow path shown in FIG. 8.

Referring now to FIGS. 4-9, various views of one embodiment of the dispenser module 200 described above with reference to FIGS. 1-3 are illustrated in accordance with aspects of the present subject matter. Specifically, FIG. 4 illustrates a front perspective view of the dispenser module 200, particularly illustrating a cover 220 of the dispenser module 200 being exploded away to show one of the detergent chambers 216 of the module 200. FIG. 5 illustrates a top, partial view of the dispenser module 200 shown in FIG. 4, particularly illustrating a compartment section 236 of the dispenser module 200 shown in FIG. 4 with the cover 220 and various cover-related components of the module 200 being removed for purposes of illustration. FIG. 6 illustrates a rear perspective view of the dispenser module 200, particularly illustrating the compartment section 236 of the module shown in FIG. 5. FIG. 7 illustrates a cross-sectional view of the dispenser module 200 shown in FIG. 5 taken about line 7-7. Additionally, FIGS. 8 and 9 illustrate similar views to those shown in FIGS. 5 and 7, respectively, particularly illustrating one example of a suitable flow path for the water flowing through the dispenser module 200.

As shown in the illustrated embodiment, the dispenser module 200 may generally include a body 202 forming the primary structural component of the dispenser module 200. The body 202 may generally extend in a heightwise direction of the dispenser module 200 (e.g., as indicated by arrows 204 in FIGS. 4-7) between a top side 206 and a bottom side 208 and in a widthwise direction of the dispenser module 200 (e.g., as indicated by arrows 210 in FIGS. 4-6) between a first or left side 212 and a second or right side 214. In addition, the body 202 may define a plurality of chambers 216, 218 for receiving detergent. For example, as particularly shown in FIG. 4, the body 202 may define two separate detergent chambers, namely a first detergent chamber 216 and a second detergent chamber 218 (shown in dashed lines), with each detergent chamber 216, 218 defining an open volume configured to receive a different type or the same type of detergent. For instance, in one embodiment, the first detergent chamber 216 may be confirmed to receive a detergent tab or gel pack whereas the second detergent chamber 218 may be configured to receive a liquid detergent (e.g., a rinse-aid additive). It should be appreciated that, in alternative embodiments, the body 202 of the dispenser module 200 may define any other suitable number of detergent chambers, such as three or more detergent chambers.

As particularly shown in FIG. 4, the dispenser module 200 may also include first and second covers 220, 222 for selectively covering and uncovering the first and second detergent chambers 216, 218, respectively. In general, each cover 220, 222 may be configured to be hingedly coupled to the body 202 at or adjacent to its respective detergent chamber 216, 218. For example, as shown in FIG. 4, a first hinge 224 may be configured to be rotatably coupled between the body 202 and the first cover 220 for allowing the first cover 220 to be moved between an opened position, wherein the first detergent chamber 216 is uncovered and accessible for insertion and/or removal of detergent, and a closed position, wherein the first detergent chamber 216 is covered and otherwise closed-off. As shown in the illustrated embodiment, suitable mounting tabs 226 may be formed on the hinge 224 that are configured to be received within corresponding openings 226 (only one of which is shown) defined in the first cover 220 for coupling the cover 220 to the hinge 224. It should be appreciated that, although not shown, a second hinge may also be provided between the body 202 and the second cover 220 to provide a hinged connection between such components.

Additionally it should be appreciated that the dispenser module 200 may also include various other components and/or features for allowing the covers 220, 222 to be latched or locked in the closed position (e.g., after initially placing detergent within each chamber 216, 218) and/or released into the open position (e.g., during the wet cycle of the dishwashing appliance 100). For example, as shown in FIG. 4, the hinge 224 may be associated with a biasing spring 230 (e.g., a helical, torsion spring) that is configured to bias the cover 220 into its opened position. In addition, the dispenser module 200 may also include a latch or locking mechanism 232 configured to maintain the cover 220 in its closed position. In such an embodiment, when it is desired for the first detergent chamber 216 to be accessible, a release mechanism 234 within the dispenser module 200 may be configured to release the locking mechanism 232, thereby allowing the biasing spring 230 to force the cover 220 into its open position.

It should be appreciated that, for purposes of illustrating the flow control features described herein, various components of the dispenser module 200 shown in FIG. 4 have been removed from FIGS. 5-9. For example, the cover 220, hinge 224, spring 230, locking mechanism 232 and release mechanism 234 have all been removed from FIGS. 5-9. It should also be appreciated that the disclosed flow control features will generally be described below with reference to the first detergent chamber 216. However, one of ordinary skill in the art should readily appreciate that such flow control features may also be utilized in connection with the second detergent chamber 218 (or with any other detergent chamber of a dispenser module) for controlling the flow of water into and/or through such chamber.

As particularly shown in FIG. 5, the dispenser module 200 may include a first compartment section 236 extending between its top and bottom sides 206, 208 that generally corresponds to the portion of the module 200 that is covered by the first cover 220 when such cover 220 is in its closed position. Additionally, the dispenser module 200 may define an outer surface 238 that extends in the heightwise direction 204 along the first compartment section 236 between the top side 206 of the body 202 and the first detergent chamber 216. For example, as shown in FIG. 7, the outer surface 238 may extend from an upper end 240 defined at or adjacent to the top side 206 of the body 202 and a lower end 242 terminating at the first detergent chamber 216.

Moreover, as shown in the illustrated embodiment, the first detergent chamber 216 may generally be configured to extend in the heightwise direction 204 along the first compartment section 236 between the lower end 242 of the outer surface 238 and the bottom side 208 of the body 202. In general, the first detergent chamber 216 may be defined by a plurality of walls. For example, as shown, the first detergent chamber 216 may include upper and lower sidewalls 244, 246 spaced apart from one another in the heightwise direction 204 of the dispenser module 200 and left and right sidewalls 248, 250 spaced apart from one another in the widthwise direction 210 of the dispenser module 200. Each of the sidewalls 244, 246, 248, 250 may generally be configured to extend inwardly in a depthwise direction of the dispenser module 200 (indicated by arrow 254 in FIG. 7) to a bottom wall 252 of the detergent chamber 216, which generally defines the base or floor of the chamber 216.

As indicated above, during operation of the dishwashing appliance 100, water flowing downwardly along the front sidewall 164A of the tub 104 may be directed across the portion of the dispenser module 200 facing outwardly in the direction of the wash chamber 106. Specifically, as indicated by arrows 300 shown in FIG. 9, water flowing down the front sidewall 164A to the top side 206 of the body 202 may be directed along the outer surface 238 of the first compartment section 236 towards the first detergent chamber 216. Unfortunately, without any suitable means for diverting or directing the flow of water, a substantial portion of the water directed along the outer surface 238 may simply pass over the top of the detergent chamber 216 as it flows towards the bottom side 208 of the body 202 and, thus, may not serve to washout any of the detergent contained within the chamber 216. However, as will be described below, the various flow control features disclosed herein may be configured to control the flow of water flowing along the outer surface 238 such that it is directed into the first detergent chamber 216, thereby allowing for enhanced washout of the detergent contained therein.

Specifically, in several embodiments, the dispenser module 200 may include one or more flow diverters 256, 258 configured to capture the flow of water flowing over the outer surface 238 of the body 202 and divert such water to a fluid collection opening 260 defined through the top of the upper sidewall 244 of the detergent chamber 216. For example, as shown in the illustrated embodiment, the dispenser module 200 includes first and second flow diverters 256, 258, with the flow diverters 256, 258 being spaced apart from one another in the widthwise direction 210 such that a flow gap 262 is defined directly between the diverters 256, 258. In such an embodiment, the flow gap 262 may be directly aligned with the fluid collection opening 260 defined in the upper sidewall 244 of the detergent chamber 216. As a result, water flowing through the flow gap 262 may be directed straight into the fluid collection opening 260.

As particularly shown in FIGS. 6 and 7, each flow diverter 256, 258 may generally include a flow diversion wall 264 extending outwardly from the outer surface 238 of the dispenser module 200. For example, in one embodiment, each flow diversion wall 264 may be configured to extend outwardly from the outer surface 238 at a 90 degree angle. Additionally, as shown in FIG. 5, each flow diversion wall 264 may generally be angled in the direction of the flow gap 262 such that water flowing along the outer surface 238 contacts each flow diversion wall 264 and is directed towards the flow gap 262. For example, each flow diversion wall 264 may be oriented in the direction of the flow gap 262 at an angle 266 (FIG. 5) ranging from about 5 degrees to about 45 degrees, such as from about 5 degrees to about 30 degrees or from about 10 degrees to about 20 degrees and any other subranges therebetween.

Moreover, as shown in FIGS. 6 and 7, each flow diverter 256, 258 may also include a projection or lip 268 extending outwardly from its respective flow diversion wall 264 in the direction of the top side 206 of the body 202. In general, each lip 268 may be configured to form a barrier or stop for preventing water from flowing over the top of the flow diverters 256, 258. For example, as particularly shown in FIG. 7, a diversion channel 270 may be defined between each lip 268 and the outer surface 238 of the body 202 along the length of each flow diverter wall 264. As such, water flowing downwardly along the outer surface 236 may fall into the diversion channels 270 and may thereafter be directed along each diversion wall 264 to the flow gap 262 for subsequent delivery to the fluid collection opening 260 (e.g., as indicated by the arrows 302 shown in FIG. 8).

Additionally, in several embodiments, the dispenser module 200 may include a plurality of sidewall ribs 272 extending lengthwise along the upper sidewall 244 of the detergent chamber 216 for directing the fluid flowing through the fluid collection opening 260 from the flow diverters 256, 258 into the detergent chamber 216. Specifically, as shown in FIGS. 4 and 7, each sidewall rib 272 may be configured to extend lengthwise along the upper sidewall 244 from the bottom wall 252 of the detergent chamber 216 to the top of the chamber 216. In addition, the sidewall ribs 272 may be configured to be aligned along the widthwise direction 210 of the dispenser module 200 with the fluid collection opening 260 defined through the top end of the upper sidewall 244. As a result, as particularly shown in FIG. 6, one or more of the sidewall ribs 272 may project upwardly into the flow path defined by the fluid collection opening 260.

Additionally, the sidewall ribs 272 may be configured to be spaced apart from one another such that a flow channel 274 is defined between each pair of adjacent ribs 272. For example, in the illustrated embodiment, the dispenser module 200 includes four sidewall ribs 272 spaced apart from one another in the widthwise direction 210 such that three separate flow channels 274 are defined along the upper sidewall 244 that extend lengthwise from the fluid collection opening 260 to the bottom wall 252 of the detergent chamber 216. However, it should be appreciated that, in alternative embodiments, the dispenser module 200 may include any other suitable number of sidewall ribs 272 defining a corresponding number of flow channels 274 therebetween.

Due to the configuration of the sidewall ribs 272 and the corresponding flow channels 274, the water flowing from the flow diverters 256, 258 through the fluid collection opening 260 may be directed into the flow channels 274 and subsequently transported along each flow channel 274 in the direction of the bottom wall 252 of the detergent chamber 216. Specifically, in several embodiments, the spacing of the sidewall ribs 272 may be selected such that the surface tension present between the water and the ribs 272 results in the water being retained between the ribs 272, thereby allowing the water to be directed along the flow channels 274 in the direction of the bottom wall 252 of the detergent chamber 216.

Referring still to FIGS. 4-9, the dispenser module 200 may also include a raised projection or spreader rib 276 extending outwardly from the bottom wall 252 of the detergent chamber 216 that is configured to spread out or otherwise disperse the water flowing into the detergent chamber 216 via the flow channels 274 along the width of the bottom wall 252. In several embodiments, the spreader rib 276 may be configured to extend at least partially around the outer perimeter of the bottom wall 262. For example, as shown in FIG. 5, the spreader rib 276 may be configured to extend in the widthwise direction 210 along at least a portion of the outer perimeter of the bottom wall 252 disposed adjacent to the interface between the upper sidewall 244 and the bottom wall 252. In addition, the spreader rib 276 may also be configured to extend in the heightwise direction 204 along at least a portion of the outer perimeter of the bottom wall 252 disposed adjacent to each interface defined between the bottom wall 252 and the left and right sidewalls 248, 250. As such, water flowing through the flow channels 274 in the direction of the bottom wall 252 may initially contact the spreader rib 276 at the location at which the sidewall ribs 272 intersect the spreader rib 276. Thereafter, due to surface tension, at least a portion of such water may stick to or otherwise flow along the spreader rib 276, thereby spreading out the flow of water in the widthwise direction 210 along the bottom wall 252. For example, as indicated by the arrows 306 shown in FIG. 8, a portion of the water flowing into the detergent chamber 216 via the flow channels 274 may be directed outwardly in the widthwise direction 210 along the spreader rib 276. Accordingly, as indicated by the arrows 308 shown in FIG. 8, the flow of water into the detergent chamber 216 may be spread out along substantially the entire width of the bottom wall 252.

Moreover, as particularly shown in FIGS. 5 and 7, the dispenser module 200 may also include a fluid collection wall 278 extending outwardly from the bottom wall 252 of the detergent chamber 216 at or adjacent to the interface defined between the bottom wall 252 and the lower sidewall 246 of the chamber 216. In general, the fluid collection wall 278 may be configured to at least partially block the flow of fluid along the bottom wall 252 of the chamber 216, thereby causing the water to at least temporarily pool-up or collect within the bottom of the chamber 216. For example, as shown in FIGS. 5 and 7, the fluid collection wall 278 may generally include a base portion 280 positioned at the interface between the bottom wall 252 and the lower sidewall 246 and an angled portion 282 extending outwardly from the base portion 280 in the direction of the upper sidewall 244. Thus, a fluid collection area 284 (FIG. 7) may be defined underneath the angled portion 282 of the fluid collection wall 278 within which water flowing along the bottom wall 252 of the detergent chamber 216 may collect and otherwise be temporarily retained before flowing out of the detergent chamber 216 along the lower sidewall 246. For instance, as shown in FIG. 5, a width 286 of the angled portion 282 of the fluid collection wall 278 may be less than the overall width of the detergent chamber 216. As such, excess fluid retained within the fluid collection area 284 may flow around the ends of the angled portion 282 (e.g., as indicated by arrows 310 shown in FIG. 8). In addition, as shown in FIG. 5, a small opening 288 may be defined through the base portion 280 of the fluid collection wall 278 such that water retained within the fluid collection area 284 may also be drained therefrom via the opening 288 (e.g., as indicated by the arrow 312 shown in FIG. 8). The water flowing around and/or through the fluid collection wall 278 may then be directed out of the detergent chamber 216 along the upper sidewall 244 of the chamber 216.

The general flow path of the water flowing through the embodiment of the dispenser module 200 shown in FIGS. 4-7 will now be described with reference to FIGS. 8 and 9. As shown, water flowing downwardly along the front sidewall 164A of the dishwasher tub 104 in the direction of the disclosed dispenser module 200 may be initially directed along the outer surface 238 of the module 200 (as indicated by arrows 300). Additionally, as particularly shown in FIG. 8, as the water flows downwardly along the outer surface 238, any water flowing along the sides of the outer surface 238 (i.e., the portions not aligned with the flow gap/fluid collection opening 260, 262) may be captured by the flow diverters 256, 258 and directed along their respective flow diversion walls 264 to the flow gap/fluid collection opening 260, 262 (as indicated by arrows 302 in FIG. 8). Thereafter, the water flowing through the fluid collection opening 260 may be directed into the flow channels 274 defined between the sidewall ribs 272 in order to be transported along the upper sidewall 244 towards the bottom wall 252 of the detergent chamber 216 (as indicated by arrows 304 shown in FIGS. 8 and 9). As the water flows through the flow channels 274 and reaches the bottom wall 252 of the detergent chamber 216, the water contacts the spreader rib 246 and is spread out in the widthwise direction 220 along the width of the bottom wall 252 (e.g., as indicated by arrows 306 shown in FIG. 8). The water may then flow downwardly along the bottom wall 252 in the direction of the fluid collection wall 278 (as indicated by arrows 308 shown in FIGS. 8 and 9). As indicated above, the water hitting the fluid collection wall 278 may temporarily pool up within the collection area 284 defined between the fluid collection wall 278 and the bottom wall 252 before being directed around and/or through the fluid collection wall 278 (as indicated by arrows 310, 312 in FIG. 8). The water may then be directed along the upper sidewall 244 and subsequently expelled from the detergent chamber 216 (as indicated by arrows 314 shown in FIGS. 8 and 9).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A detergent dispenser module for a dishwashing appliance, the detergent dispenser module comprising:

a body extending between a top side and a bottom side, the body including an outer surface extending from the top side and defining a detergent chamber between the outer surface and the bottom side, the detergent chamber being at least partially formed by an upper sidewall, a lower sidewall and a bottom wall extending between the upper and lower sidewalls; and at least one flow diverter including an angled wall extending outwardly from the outer surface at a location adjacent to the upper sidewall of the detergent chamber, the angled wall being angled in a direction of a fluid collection opening defined through a top of the upper sidewall such that fluid flowing downwardly along the outer surface of the body is directed into the fluid collection opening, the at least one flow diverter further comprising a lip extending outwardly from the angled wall towards the top side of the body.

2. The detergent dispenser module of claim 1, wherein the at least one flow diverter comprises a first flow diverter and a second flow diverter, the first flow diverter being spaced apart from the second flow diverter such that the fluid collection opening is defined between the first and second flow diverters, both the first and second flow diverters being angled in the direction of the fluid collection opening such that the fluid flowing downwardly along the outer surface of the body is directed between the first and second flow diverters and into the fluid collection opening.

3. The detergent dispenser module of claim 1, further comprising a first sidewall rib and a second sidewall rib extending lengthwise along the upper sidewall of the detergent chamber, the first sidewall rib being spaced apart from the second sidewall rib such that a flow channel is defined between the first and second sidewall ribs, the flow channel being in flow communication with the fluid collection opening such that the fluid flowing through the fluid collection opening is directed into the flow channel and travels within the flow channel along the upper sidewall towards the bottom wall of the detergent chamber.

4. The detergent dispenser module of claim 3, wherein the first and second sidewall ribs are spaced apart from one another such that the fluid is retained within the flow channel due to surface tension between the first and second sidewall ribs and the fluid.

5. The detergent dispenser module of claim 1, further comprising a spreader rib projecting outwardly from the bottom wall of the detergent chamber, the spreader rib extending at least partially along an outer perimeter of the bottom wall defined at an interface between the bottom wall and the upper sidewall of the detergent chamber such that, when the fluid flowing through the fluid collection opening is directed along the upper sidewall towards the bottom wall, the spreader rib is configured to spread out the flow of fluid along a width of the bottom wall.

6. The detergent dispenser module of claim 5, further comprising a fluid collection wall extending within the detergent chamber adjacent to an interface defined between the lower sidewall and the bottom wall of the detergent chamber, the fluid collection wall being configured to at least partially block the fluid flowing along the bottom wall from flowing upward along the lower sidewall.

7. A detergent dispenser module for a dishwashing appliance, the detergent dispenser module comprising:

a body extending between a top side and a bottom side, the body including an outer surface extending from the top side and defining a detergent chamber between the outer surface and the bottom side, the detergent chamber being at least partially formed by an upper sidewall, a lower sidewall and a bottom wall extending between the upper and lower sidewalls, the upper sidewall defining a fluid collection opening at a top of the upper sidewall that is in fluid communication with the outer surface; and first and second sidewall ribs extending lengthwise along the upper sidewall of the detergent chamber, the first sidewall rib being spaced apart from the second sidewall rib such that a flow channel is defined between the first and second sidewall ribs, the flow channel being in flow communication with the fluid collection opening such that fluid flowing downwardly along the outer surface of the body is directed through the fluid collection opening and into the flow channel for transport within the flow channel along the upper sidewall towards the bottom wall of the detergent chamber.

8. The detergent dispenser module of claim 7, wherein the first and second sidewall ribs are spaced apart from one another such that the fluid is retained within the flow channel due to surface tension between the first and second sidewall ribs and the fluid.

9. The detergent dispenser module of claim 7, wherein the first and second sidewall ribs form part of a plurality of sidewall ribs extending lengthwise along the upper sidewall of the detergent chamber, the plurality of ribs being spaced apart from one another along a width of the upper sidewall such that a plurality of flow channels are defined along the upper sidewall.

10. The detergent dispenser module of claim 7, further comprising a spreader rib projecting outwardly from the bottom wall of the detergent chamber, the spreader rib extending at least partially along an outer perimeter of the bottom wall defined at an interface between the bottom wall and the upper sidewall of the detergent chamber such that, when the fluid flowing through the fluid collection opening is directed along the upper sidewall towards the bottom wall, the spreader rib is configured to spread out the flow of fluid along a width of the bottom wall.

11. The detergent dispenser module of claim 10, further comprising a fluid collection wall extending within the detergent chamber adjacent to an interface defined between the lower sidewall and the bottom wall of the detergent chamber, the fluid collection wall being configured to at least partially block the fluid flowing along the bottom wall from flowing upward along the lower sidewall.

12. The detergent dispenser module of claim 7, further comprising at least one flow diverter extending outwardly from the outer surface at a location adjacent to the upper sidewall of the detergent chamber, the at least one flow diverter being angled in a direction of the fluid collection opening such that the fluid flowing downwardly along the outer surface of the body is directed into the fluid collection opening.

13. The detergent dispenser module of claim 12, wherein the at least one flow diverter comprises a first flow diverter and a second flow diverter, the first flow diverter being spaced apart from the second flow diverter such that the fluid collection opening is defined between the first and second flow diverters, both the first and second flow diverters being angled in the direction of the fluid collection opening such that the fluid flowing downwardly along the outer surface of the body is directed between the first and second flow diverters and into the fluid collection opening.

14. A detergent dispenser module for a dishwashing appliance, the detergent dispenser module comprising:

a body extending between a top side and a bottom side, the body including an outer surface extending from the top side and defining a detergent chamber between the outer surface and the bottom side, the detergent chamber being at least partially formed by an upper sidewall, a lower sidewall and a bottom wall extending between the upper and lower sidewalls, the upper sidewall defining a fluid collection opening at a top of the upper sidewall that is in fluid communication with the outer surface; and a spreader rib projecting outwardly from the bottom wall of the detergent chamber, the spreader rib extending at least partially along an outer perimeter of the bottom wall defined at an interface between the bottom wall and the upper sidewall of the detergent chamber such that, when fluid flowing downwardly along the outer surface of the body travels through the fluid collection opening and is directed along the upper sidewall towards the bottom wall, the spreader rib is configured to spread out the flow of fluid along a width of the bottom wall.

15. The detergent dispenser module of claim 14, wherein the detergent chamber is further defined by a left sidewall and a right sidewall, wherein the spreader rib further extends along the outer perimeter of the bottom wall at an interface defined between the left sidewall and the bottom wall and at an interface defined between the right sidewall and the bottom wall.

16. The detergent dispenser module of claim 14, further comprising a fluid collection wall extending within the detergent chamber adjacent to an interface defined between the lower sidewall and the bottom wall of the detergent chamber, the fluid collection wall being configured to at least partially block the fluid flowing along the bottom wall from flowing upward along the lower sidewall.

17. The detergent dispenser module of claim 16, wherein at least a portion of the fluid collection wall is angled in the direction of the upper sidewall of the detergent chamber.

18. The detergent dispenser module of claim 14, further comprising at least one flow diverter extending outwardly from the outer surface at a location adjacent to the upper sidewall of the detergent chamber, the at least one flow diverter being angled in a direction of the fluid collection opening such that the fluid flowing downwardly along the outer surface of the body is directed into the fluid collection opening.

19. The detergent dispenser module of claim 14, further comprising first and second sidewall ribs extending lengthwise along the upper sidewall of the detergent chamber, the first sidewall rib being spaced apart from the second sidewall rib such that a flow channel is defined between the first and second sidewall ribs, the flow channel being in flow communication with the fluid collection opening such that the fluid flowing downwardly along the outer surface of the body is directed through the fluid collection opening and into the flow channel for transport within the flow channel along the upper sidewall towards the bottom wall of the detergent chamber.

* * * * *